United States Patent [19]

Tiphaine

[11] Patent Number: 4,846,135

[45] Date of Patent: Jul. 11, 1989

[54] DEVICE FOR RECOVERING GASOLINE VAPORS

[75] Inventor: Jean Tiphaine, Maule, France

[73] Assignees: Automobiles Peugeot, Paris; Automobiles Citroen, Neuillylseine, both of France

[21] Appl. No.: 225,931

[22] Filed: Jul. 29, 1988

[30] Foreign Application Priority Data

Jul. 30, 1987 [FR] France ..... 87 10830

[51] Int. Cl.[4] ..... F02M 39/00

[52] U.S. Cl. ..... 123/520; 123/557; 123/518

[58] Field of Search ..... 123/516, 518, 519, 520, 123/521, 556, 555, 557

[56] References Cited

U.S. PATENT DOCUMENTS

| | | | |
|---|---|---|---|
| 3,643,690 | 2/1972 | Sarai | 123/520 |
| 3,765,435 | 10/1973 | Schlanzky | 123/520 |
| 3,800,978 | 4/1974 | Sigwald | 123/520 |
| 3,910,302 | 10/1975 | Sudhir | 123/520 |
| 3,970,098 | 7/1976 | Boswank et al. | 123/520 |
| 3,996,951 | 12/1976 | Parr et al. | 123/520 |
| 4,095,609 | 6/1978 | Martin | 123/520 |
| 4,579,135 | 4/1986 | Sakata et al. | 123/520 |

FOREIGN PATENT DOCUMENTS

| | | | |
|---|---|---|---|
| 0161952 | 12/1980 | Japan | 123/519 |
| 0000544 | 1/1981 | Japan | 123/519 |
| 0220951 | 12/1983 | Japan | 123/520 |
| 0020668 | 1/1987 | Japan | 123/518 |

*Primary Examiner*—Carl Stuart Miller

*Attorney, Agent, or Firm*—Burns, Doane, Swecker & Mathis

[57] ABSTRACT

The device includes a filter containing a material which adsorbs the vapors coming from a tank. The filter is connected through a first duct to the upper part of the tank, through a second duct to a source of depression and through a third duct to a source of air for regenerating the adsorbent material. Apparatus is provided for heating the regenerating air. The device further includes apparatus for regulating the temperature of the air flowing in the third duct, this apparatus has a temperature response control element disposed in the filter. The device is particularly useful in automobile vehicles.

7 Claims, 2 Drawing Sheets

DEVICE FOR RECOVERING GASOLINE VAPORS

The present invention relates to devices for recovering gasoline vapors coming from the gasoline tank of a motor vehicle.

Such devices are known which comprise a filter for adsorbing said gasoline vapors, this filter being connected through a first duct to the upper part of the tank, through a second duct to a source of depression which is generally constituted by the intake circuit of the engine, and through a third duct to a source of air for regenerating the adsorbent material, means being provided if desired for heating this regenerating air.

Such a device fixes the gasoline vapors which come from the tank owing to the evaporation of the gasoline, in particular in hot weather, or to the displacement of the mass of gas overlying the liquid in the tank when the latter is being filled.

The material adsorbing said gasoline vapors may be activated carbon which becomes charged with the gasoline vapors when the gas flows from the first duct to the second duct via the filter and which is regenerated when it is swept through by a counter-current of the regenerating air flowing from the third duct to the second duct. This sweeping occurs by aspiration in the second duct which is due in particular to the depression prevailing in the intake circuit of the engine when the latter is running.

The effectiveness of the regeneration is improved if the sweeping or purging air has sufficient temperature and this is why a heating of this air has been proposed in a known arrangement. However, such a heating is liable to cause an overheating of the activated carbon and consequently to rapidly deteriorate the latter.

An object of the invention is to improve the operating capacity of a filter incorporated in a device for recovering gasoline vapors, without running the risk of a rapid deterioration of the active material contained in this filter. The invention also proposes, owing to the improvement of this capacity, reducing the dimension of the filter and consequently the price and overall size thereof.

The invention therefore provides a device for recovering gasoline vapors from a tank, comprising a filter containing a material for adsorbing said vapors, said filter being connected through a first duct to the upper part of the tank, through a second duct to a source of depression, and through a third duct to a source of air for regenerating the adsorbent material, and means for heating the regenerating air, wherein regulating means are provided which act on the regenerating air heating means and comprise a temperature responsive control element disposed in the filter.

According to other features of the invention:

the control element is carried by a metal plate embedded in the mass of adsorbent material;

the heating and regulating means comprise a heating resistor connected in series with the control element;

the third duct is connected to a source of cold air and to a source of hot air under the control of a closure member;

the closure member is actuated by a depression capsule connected to an intake pipe of the engine through a thermovalve constituting the control element;

an electrical valve controlled as a function of at least one operating parameter of the engine is placed between the thermovalve and the intake pipe;

an electrical valve controlled as a function of at least one operating parameter of the engine is placed in the second duct;

the control element and/or said electrical valves are controlled by a computer which controls and manages the operation of the engine.

The invention will now be described in more detail hereinafter with reference to the accompanying drawings in which.

Figure 1:
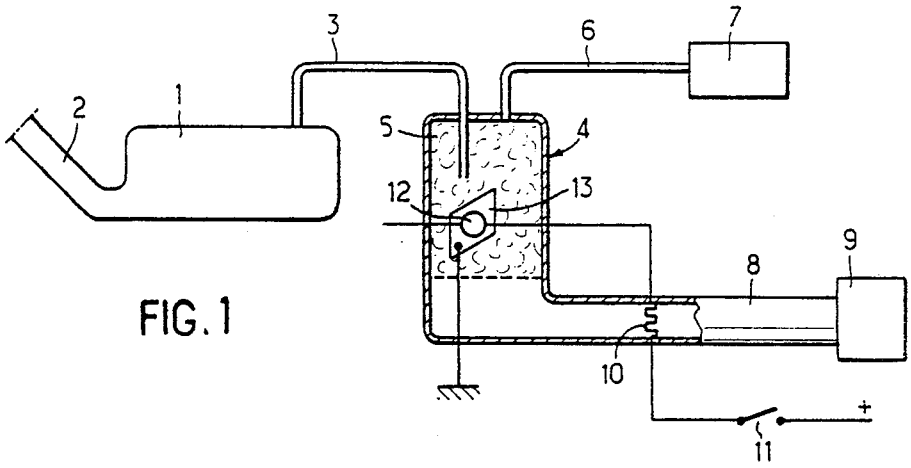
FIG. 1 is a diagram illustrating a first embodiment of a device according to the invention.

FIG. 1 shows diagrammatically a fuel tank 1 in an automobile vehicle. This tank comprises a filling pipe 2 and, extending from a point located in the upper part of the pipe, is a first duct 3 connected to a filter 4 containing a material 5 capable of adsorbing the gasoline vapors, for example activated carbon. Extending from this filter is a second duct 6 connected to a source 7 of depression which is preferably the intake pipe of the engine (not shown) of the vehicle.

The filter is connected through a third duct 8 to a source 9 of air for regenerating the activated carbon.

Placed in this duct 8 is an electric resistor 10 which may be supplied with current by the battery of the vehicle. This resistor is connected in series with a switch 11 which is closed when the engine is running and with a cell 12 having a positive temperature coefficient carried by a metal plate 13, for example composed of aluminum, embedded in the mass of activated carbon. The cell 12 constitutes a probe whose resistance varies as a function of the temperature of the mass of activated carbon. The metal plate 13 performs the function of a radiator whereby it is possible to bring the temperature of the cell to the temperature of the environment.

Figure 2:
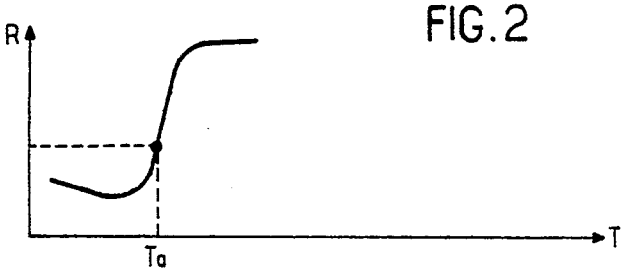
FIG. 2 is a graph representing the characteristic of operation of a positive temperature coefficient probe employed in this device.

The resistance of the cell 12 varies as a function of the temperature in accordance with the curve shown in Fig. 2. Above $T_a$, this resistance very rapidly increases. The operation of the device is then as follows:

The gasoline vapors coming from the tank through the duct 3 are fixed in the filter by adsorption on the activated carbon 5, in particular when filling the tank or when the vehicle is operating in very hot weather.

When the engine of the vehicle is running, the activated carbon is regenerated, since a stream of air, coming from the duct 8 and aspirated through the duct 6, flows therethrough. The fact of heating this airstream by means of the resistor 10 facilitates this regeneration and increases the operating capacity of the activated carbon. It will be recalled in this respect that this operating capacity is measured by the difference between the mass of the filter in the saturated state and its mass in the purged or regenerated state.

During the regenerating stage, the cell 12 having a positive temperature coefficient responds to the temperature prevailing in the mass of activated carbon. So long as this temperature remains lower than the value $T_a$, its electric resistance is low so that the current can pass therethrough and the resistor 10 gives off by the Joule effect a relatively large amount of heat causing the heating of the activated carbon.

On the other hand, when the temperature of the activated carbon exceeds the value $T_a$, the resistance of the cell 12 increases and renders the amount of heat given off by the resistor 10 by the Joule effect very low or even negligible. The heating of the activated carbon is interrupted and its temperature becomes stabilized.

It will be understood that the characteristics of the cell 12 are so determined that its own heating by the Joule effect is negligible relative to that due to the heating resistor 10.

By way of example, an order of magnitude of the electrical power given off by the heating resistor 10 may be a few tens of watts.

Figure 3:
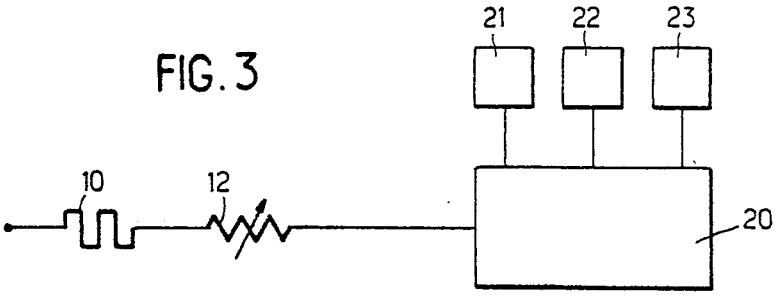
FIG. 3 is a diagram illustrating a variant of the device according to the invention.

The diagram of FIG. 3 shows the supply circuit of the heating resistor 10 and the cell 12 having a positive temperature coefficient, this circuit being controlled for example by a computer 20 which controls and manages the operation of the engine and is so arranged as to allow the purge or the regeneration of the filter only when a number of conditions related to the operation of the engine are in effect satisfied. Thus, the computer may be connected to suitable means 21, 22, 23 known per se which deliver thereto signals representing the temperature of the coolant water of the engine, the load on the latter and the control of the richness of the mixture fed to the engine. By way of example, the purge will only be allowed if the engine is sufficiently warm, if the load thereon exceeds a given value, and if the richness of the intake mixture is controlled and regulated at a given value.

In the diagrams of FIGS. 1 and 3, the cell 12 having a positive temperature coefficient may be replaced by a thermocontact carried by the metal plate which is normally closed and opens when the temperature exceeds a given value.

Figure 4:
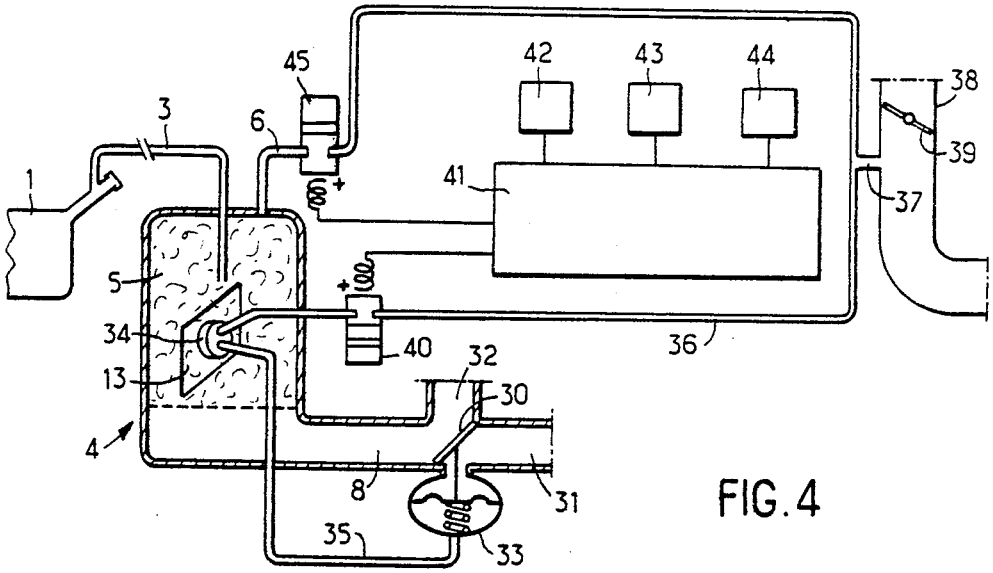
FIGS. 4 and 5 are two other diagrams representing two other variants of said device.

In another embodiment shown in FIG. 4, the duct 8 may be connected, under the action of a flap 30, either to a source 31 of cold air or to a source 32 of hot air. In the last mentioned case, the air may be heated by putting it in contact with the exhaust pipe of the engine. This flap 30 is controlled by a depression capsule 33 controlled by a thermovalve 34 mounted on the metal plate 13 embedded in the mass 5 of activated carbon.

For this purpose, the capsule 33 is connected through a duct 35 to the thermovalve 34, itself connected through a second duct 36 to a source of depression obtained by a branch connection 37 to the intake circuit 38 of the engine. In the case of FIG. 4, this branch connection is located on the downstream side of the gasoline control butterfly valve 39 so that it is constantly subjected to a depression when the engine is running.

Placed in the duct 36 is an electrical valve 40 controlled by a computer 41 controlling and managing the operation of the engine, this computer being, as before, arranged to process data representing the temperature of the coolant liquid of the engine, the load and the richness of the mixture, delivered by probes or other suitable means 42, 43, 44.

Provided in the duct 6 leading to the same branch connection 37 is an electrical valve 45 controlled by the same computer. This control of the electrical valve 45 has for purpose to purge or regenerate the filter under such conditions that this purge does not create a substantial disturbance in the feeding of fuel to the engine, since the gasoline vapors coming from the filter are thereafter transmitted to the intake of the engine.

Figure 5:
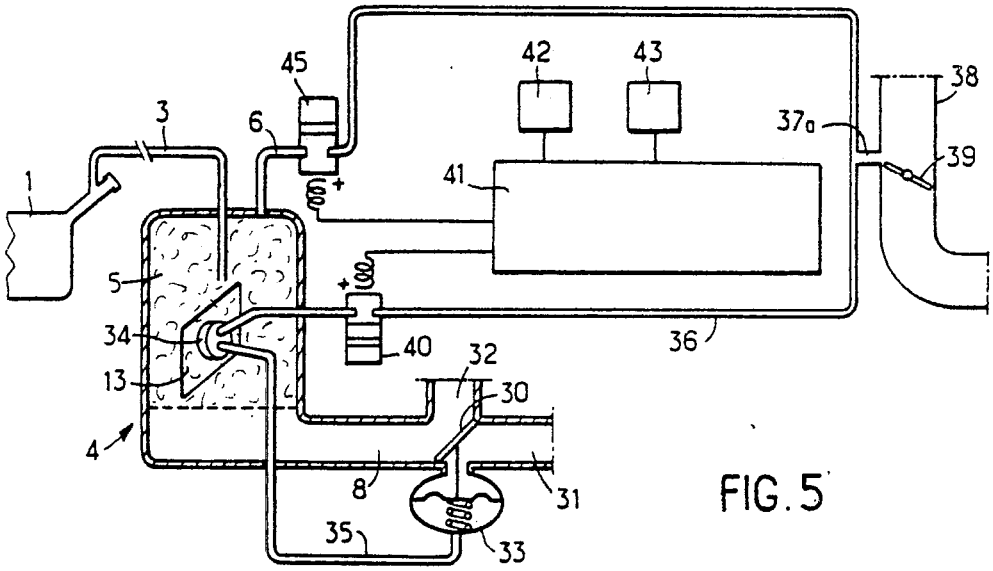

In the case of FIG. 5, the same main arrangements of the diagram of FIG. 4 are found except that the branch connection **37*a* is located on the upstream side of the gasoline control butterfly valve when the latter is closed; The location of this branch connection is so chosen that the depression created therein when the butterfly valve is opened corresponds to the desired level of the load on the engine for allowing the purge in the filter 4**. In this case, the computer merely has to take into account the temperature of the coolant liquid of the engine and the regulation of the richness of the mixture fed to this engine.

The device then operates in the following manner:

With the filter charged with gasoline vapors through the duct 3, in particular when filling the tank or when the vehicle is stationary in very hot weather, the filter is regenerated when the conditions of operation of the engine allow the purge through the duct 6, the computer 41 then delivering to the electrical valves 40 and 45 an opening signal. This puts the capsule 33 under depression and causes the displacement of the flap 30 to a position in which it closes the cold air supply duct 31 and opens the hot air supply duct 32. A stream of hot air then flows through the filter toward the duct 6 and this stream is regulated by the thermovalve 34 which acts through he medium of the capsule 33 on the flap 30 to ensure that the temperature of the activated carbon does not exceed a given value.

In the various illustrated embodiments in which modifications may of course be made, the operating capacity of the activated carbon filter is improved and it is consequently possible to reduce its dimensions and even its cost and overall size. This is of particular interest in the envisaged application in which it is associated with an automobile vehicle tank.

I claim:

1. A device for recovering gasoline vapors from a tank, said device comprising a filter containing a material adsorbing said vapors, a source of depression, a source of air for regenerating the adsorbent material, a first duct for connecting the filter to an upper part of the tank, a second duct for connecting the filter to said source of depression, a third duct for connecting the filter to said source of air, means for heating said regenerating air, and means for regulating the temperature of the air which flows in the third duct, said temperature regulating means comprising a control element which is responsive to temperature and disposed in the filter; wherein said source of air comprises a source of cold air and a source of hot air and the third duct is connected to said source of cold air and to said source of hot air, and a closure member is associated with said source of cold air and said source of hot air for selecting the required source from said two sources.

2. A device according to claim 1, in combination with an engine having an intake pipe, said device further comprising a depression capsule and a thermovalve constituting said control element for connecting the capsule to said intake pipe.

3. A device according to claim 2, further comprising an electrical valve interposed between said thermovalve and said intake pipe, and means for controlling said electrical valve as a function of at least one operating parameter of said engine.

4. A device according to claim 1, in combination with an engine, said device further comprising an electrical valve inserted in the second duct and means for controlling the electrical valve as a function of at least one operating parameter of said engine.

5. A device according to claim 1, in combination with a vehicle having an engine, wherein a computer which controls and manages the operation of the engine also controls said control element.

6. A device according to claim 3, wherein a computer which controls and manages the operation of the engine also controls said electrical valve.

7. A device according to claim 4, wherein a computer which controls and manages the operation of the engine also controls said electrical valve.

* * * * *